US007490949B2

(12) United States Patent
Medinis

(10) Patent No.: US 7,490,949 B2
(45) Date of Patent: Feb. 17, 2009

(54) SURGICAL HEADLAMP

(76) Inventor: David M. Medinis, 9530 Gladiolus Blossom Cir., Ft. Myers, FL (US) 33908

( * ) Notice: Subject to any disclaimer, the term of this patent is extended or adjusted under 35 U.S.C. 154(b) by 32 days.

(21) Appl. No.: 11/638,940

(22) Filed: Dec. 14, 2006

(65) Prior Publication Data

US 2008/0144305 A1 Jun. 19, 2008

(51) Int. Cl.
*F21V 21/084* (2006.01)

(52) U.S. Cl. ..... 362/105; 362/294; 362/373; 362/800; 362/804

(58) Field of Classification Search ..... 362/105, 362/244, 294, 373, 800, 804
See application file for complete search history.

(56) References Cited

U.S. PATENT DOCUMENTS 6,955,444 B2 * 10/2005 Gupta ..... 362/105
7,192,151 B2 * 3/2007 Clupper et al. ..... 362/105
7,304,418 B2 * 12/2007 Nagata et al. ..... 362/800

* cited by examiner

*Primary Examiner*—Stephen F Husar
(74) *Attorney, Agent, or Firm*—Edwin W. Oldham

(57) ABSTRACT

A surgical headlamp containing dual lamp housings, each containing multiple LED light sources is featured. Both lamp housings may be adjusted so that light beams emitted by each LED be selectively converged through a focusing lens at a spot a predetermined distance in front of the lamp housings. Each lamp housing typically contains in addition to the LED's, one or more focusing lenses to gather and direct the light generated by the LED's forward to an illuminated work area. Batteries, preferably rechargeable, are mounted either on the headband supporting the headlamp on a users head or external to the headband, are used to power the LED's. A cooling system for the LED's is included, which utilizes a heat sync associated with the printed circuit board for the LED's, combined with a liquid cooling solution which is pumped in chamber surrounding the base of the heat sync of the LED light system.

12 Claims, 4 Drawing Sheets

SURGICAL HEADLAMP

I. BACKGROUND OF THE INVENTION

A. Field of Invention

The present invention pertains to lights that can be worn on a users head to provide illumination in an area of work, and, more particularly, to a head light for surgeons, dentists or other medical personnel or craftsman. The light uses two independent lamp housings, working cooperatively to converge light beams at a predetermined distance from the LED light sources.

It is essential in certain medical procedures that the physician, surgeon, or dentist has his or her hands free for manipulating various surgical, diagnostic or therapeutic instruments. At the same time, the particular part of the patients body that the physician or surgeon is treating must be adequately illuminated. For these purposes, doctors and surgeons have here before utilized surgical headlights, some of which require the user to remain attached by a fiber optics to a freestanding light source, and/or to a power outlet or an energy source.

Battery powered, head mounted lamps utilizing an incandescent lamp as a light have also been used. Typically, the high power consumption, relatively low light output, high weight, and short battery life of such devices of the prior art have made their use difficult, uncomfortable, or otherwise unsatisfactory.

Even with such configurations, however, the amount of light illuminating upon the work area can be inadequate. There have been attempts to increase the light pinching upon the work area by utilizing xenon or halide lamps which require high power and have a relatively short bulb life and generate substantial amounts of heat.

Some of the problems associated with such xenon and halide lights may be overcome by utilizing light emitting diodes (LEDs).

Some prior art apparatus have used relatively high-powered LEDs to generate sufficient light output. Such LEDs typically generate so much heat that a heat sync is required heretofore the prior art has not been able to satisfy the requirement of a heat sync or cooling system for LED light generation.

B. Discussion of the Related Art

Several attempts to solve the problems described hereinabove have been made in the prior art. For example, published U.S. Pat. No. 6,955,444 published Jun. 2, 2005, and issued as a patent on Oct. 18, 2005 for Surgical Headlight by Sushil Gupta, teaches a head mounted lamp assembly with at least two LED's mounted side-by-side and focused utilizing a rear reflector. Such rear reflector use greatly diminishes the efficiency of the projection of the light generated by the LED and thus is unsatisfactory for providing a high intensity, focus light beam of the apparatus of the present invention.

U.S. Pat. No. 7,108,400 entitled Light Source Unit and Projector by inventor Shuhei Yamada and Takeshi Seto teaches the use of a LED light source for rumination of high luminants which includes a cooling system for the illumination of high luminants which generates substantial heat. This design utilizes two liquid heat source absorbers and is very complex and is much more difficult to implement than that cooling system taught by the present invention.

U.S. Published Patent Application 2005/0243539 teaches a cooled light emitting apparatus comprising a light source including a close packed array of light emitting diodes and a cooling system for cooling the light source. The cooling system is a thermoelectric cooling device in the form of a peltier device connected by a heat spreader to the light source and a heat exchange system for removing heat from the peltier device. The heat exchange system utilizes a liquid coolant to cool the pettier device in this instance the invention utilizes a heat pipe configuration or arrangement and this is far less satisfactory than the liquid cooling system taught by the present invention.

II. SUMMARY OF THE INVENTION

In accordance with the present invention, there is provided a surgical headlight that overcomes the problems of head mounted surgical headlamps of the prior art. A plurality of LED's are mounted in a circular arrangement on a printed circuit board which includes a metal substrate heat sync associated therewith that is contact with a coolant chamber and a belt mounted cooling liquid is pumped through the cooling chamber to control the heat output from the LED array mounted under and focused by a focus lens that is a single lens that focuses all of the diodes into a coherent focused pattern at a particular point of desired focus and intensity.

It is, therefore, an object of the invention to provide a head-mounted, LED based headlamp for use by surgeons or other medical personnel, etc. It is another object of the invention to provide a head mounted, LED based headlamp comprised of a pair of individual lamp housings each incorporating a plurality of LED cells and each unit mounted with associated with a focus lens that focuses the provides a 6° focus angle for an effective 200 mm circle of light at 440 mm.

It is a further object of the invention to provide a head mounted, LED based headlamp powered by rechargeable batteries.

It is a further object of the invention to provide a head mounted, LED based headlamp which has a bulb life of at least 50 times that of a xenon/halide bulb while operating at a less than ⅙ the wattage requirement of such xenon/halide bulb.

It is a further object of the invention to provide a head mounted, LED based headlamp which is very reasonable in cost and provides a significant solid-state semi-coherent light for passage through a focus lens at a 6° focus angle for an effective 200 mm circle of light at 440 mm.

III. BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, components and elements of the apparatus of this invention will bear the same designations or numbering throughout the Figures.

IV. DETAILED DESCRIPTION OF THE PREFERRED EMBODIMENT

The present invention provides a surgical headlight, which may be used by surgeons, physicians, dentists, etc., who require a reliable, portable, high density, battery powered light source For the sake of brevity, the term surgeon is used hereinafter to refer to any user of the head-mounted headlamp of the invention.

Figure 1:
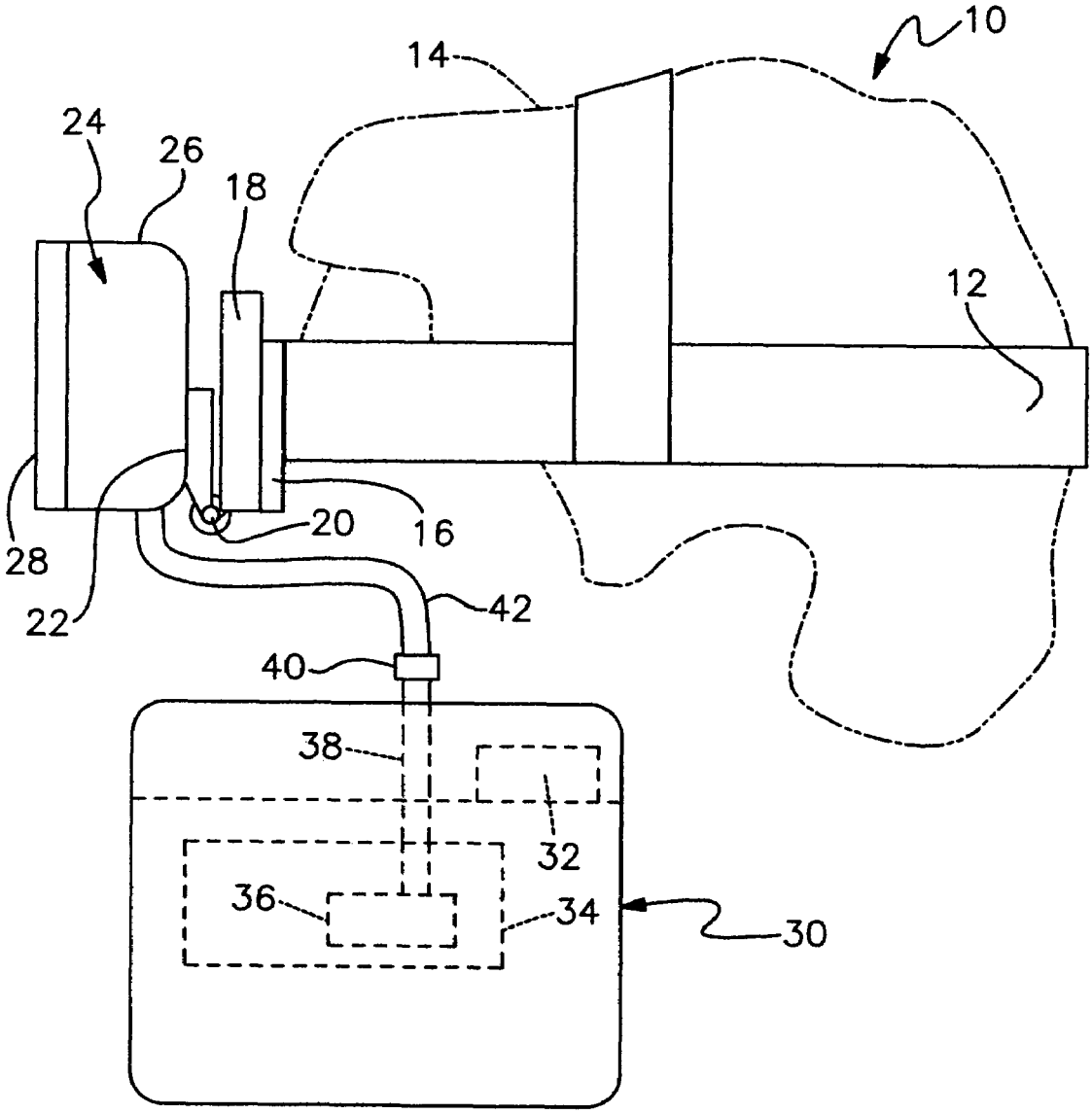
FIG. 1 is a side view in schematic form of the head light assembly system of the invention showing the head mount strap the headlight itself and the remotely located cooling and battery powered system assembly.

Referring first to FIG. 1 of the drawings, the numeral 10 indicates generally the head-mounted headlamp of the invention which comprises a basic band 12 to go around the head and forehead of the user, and this band 12 is normally adjustable to be able to therefore fit the size of the wearer of the unit. A top strap 14 is shown which goes over the top of the head of the user and stabilizes the whole assembly to fit comfortably and securely onto the users head, in much the typical way of any of these devices.

Figure 6:
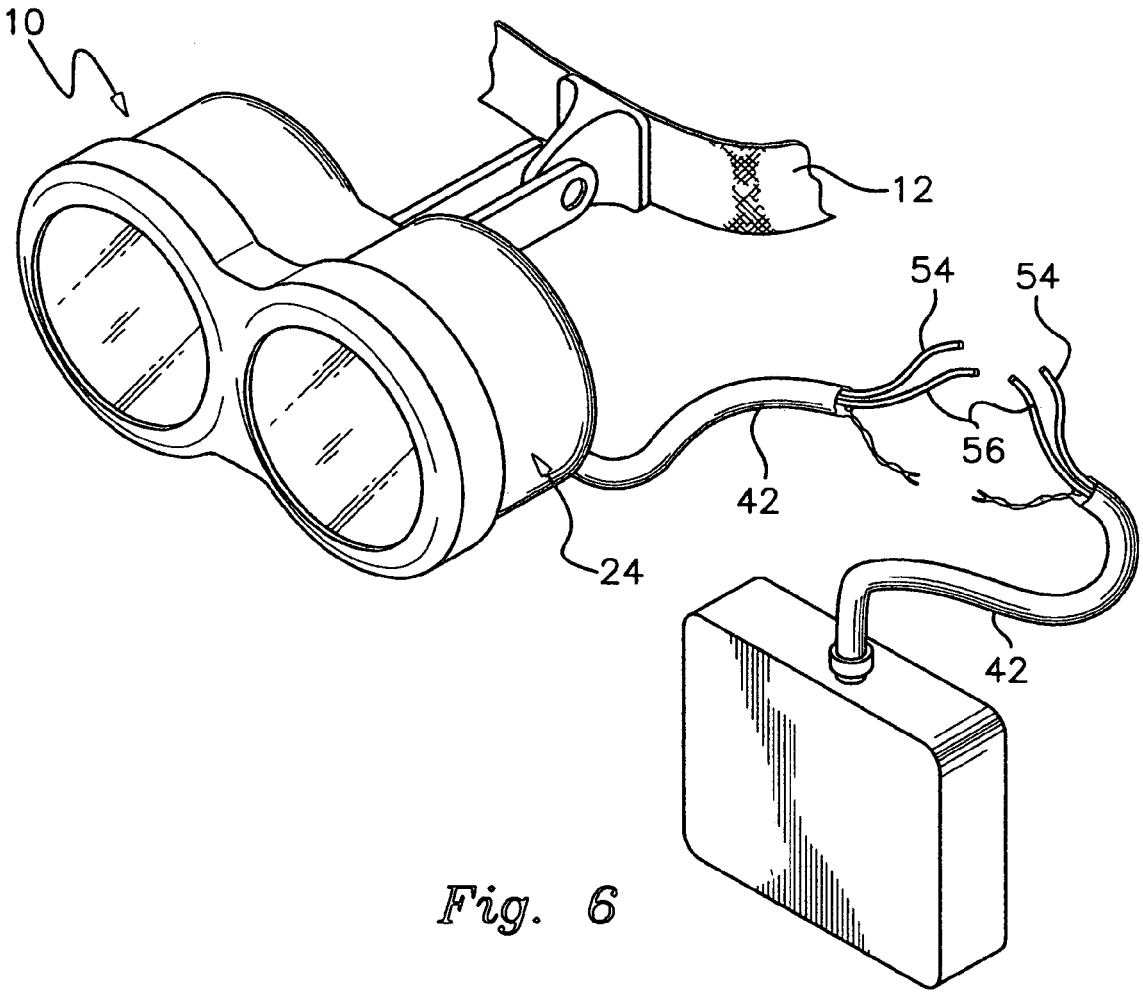
FIG. 6 is a perspective view of the headlamp of FIG. 1 showing two headlamps in side by side relationship.

The band 12 mounts then to a mounting plate 16 which attaches itself to a further forehead plate 18 and plate 18 operates through a ratcheting swivel 20 to provide an actual mounting plate 22 which carries the improved head mounted headlamp 24 of the invention. The basic headlamp 24 is composed of two separate lamps 24, as best seen in FIG. 6. The basic headlamp is comprised of a rearward housing 26 which carries the actual LED configuration, and cooling to be described later, and a front protective cover for the focusing lenses, as described in conjunction with FIG. 4.

The auxiliary package is indicated generally by numeral 30 and this is remotely mounted normally on the waist or the back through a belt arrangement typically suitable for the user. This auxiliary package incorporates a LED power supply 32 which is shown in dotted line. The power supply 32 is a conventional rechargeable battery typically used for this type of system and is conveniently located for replacement or recharging in the box assembly 30. The box 30 also incorporates a coolant reservoir 34 again shown in dotted line and coolant reservoir incorporates a coolant pump 36 again shown in dotted line and the pump 36 transmits coolant through a coolant tube 38 also indicated by dotted line within the box 30 and then there is a quick connect or disconnect unit 40 located between the flexible tubing that constitutes the tubing 42 that sends the coolant fluid up and into its appropriate use for cooling in the headlamp assembly 24.

Figure 2:
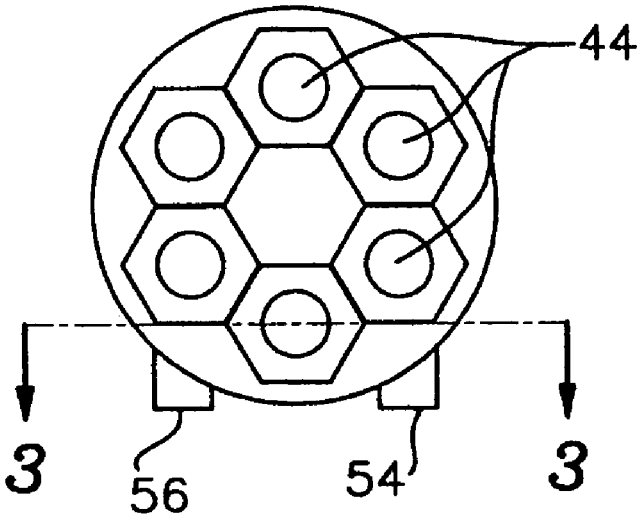
FIG. 2 is a top schematic view of the headlight assembly utilized as one of the two assemblies associated with the headlamp of the invention and showing the focus lenses each individually hexagonal in shape, and arranged into a hexagonal circular shape with the six lenses touching on the flat outer sides, as shown.
Figure 3:
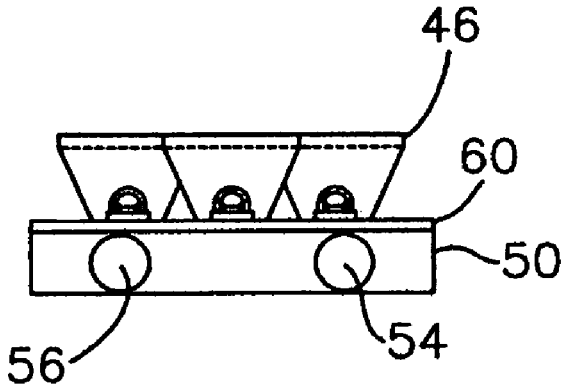
FIG. 3 is a side cross-sectional elevation, taken on line 3-3 of FIG. 2, of the three LED's associated with one side of the headlamp and showing the construction of the focusing lenses and the heat sync associated therewith as well as the cooling chamber.
Figure 4:
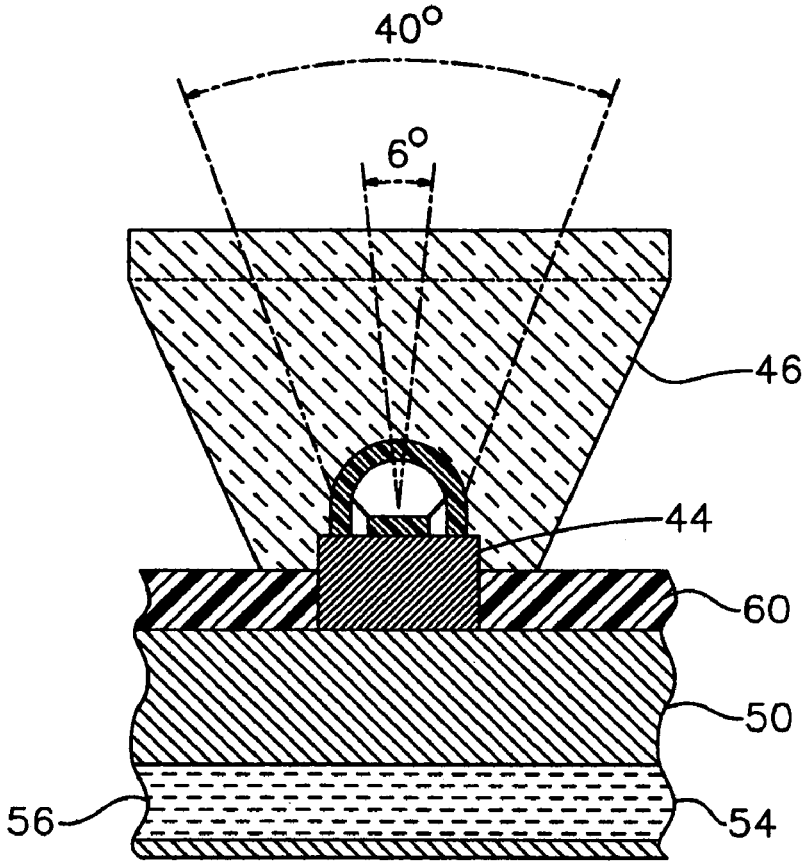
FIG. 4 is a cross-sectional elevation showing of one of the focusing lenses showing the relationship between the cone of light emission from the LED, and the resultant condensing of that emission into a focused cone of light achieved by the focusing lens.
Figure 5:
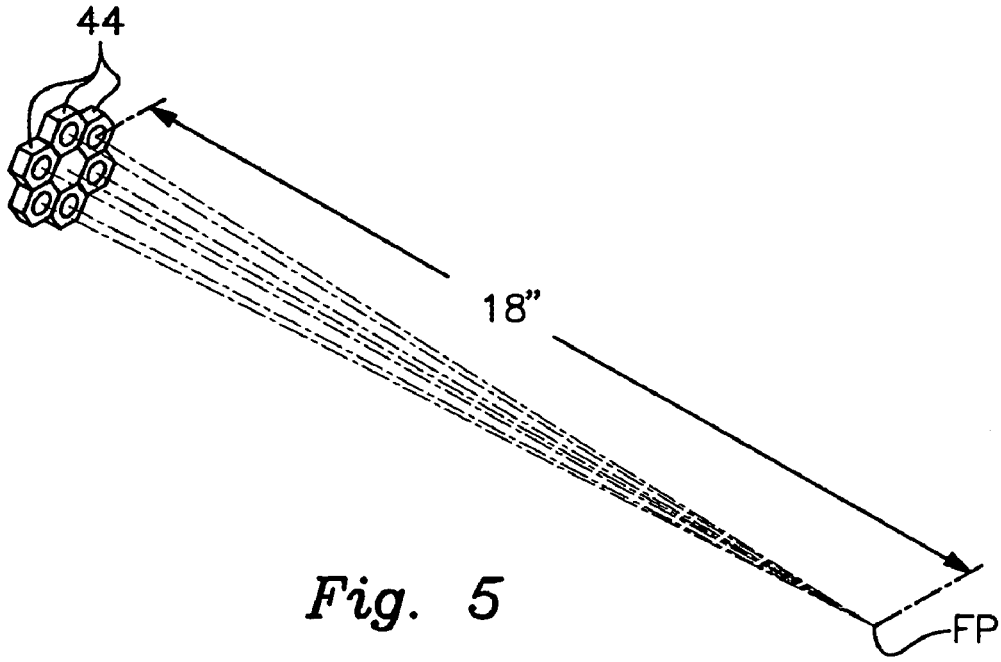
FIG. 5 is a schematic perspective showing of the six LED's in hexagonal array, and each pointed at the specific focal point desired.

Referring now to the headlamp assembly 24 shown in FIG. 2 of the drawings, the headlamp includes a plurality of LED's indicated by numeral 44. The LED's are mounted in a hexagonally shaped focusing lens 28 that comprises a plurality of independent lenses 46 associated with each LED. The lens 28 is preferably a solid polymer molding to incorporate six individual lenses 46, all physically connected to a central hexagonal piece 47, all as one overall piece by a separate mold that locates the lenses as shown in FIG. 5 so as to focus at a point approximately 18 inches from the lenses 46. This will be explained in more detail with respect to the drawings shown in FIGS. 3 and 4.

Figure 7:
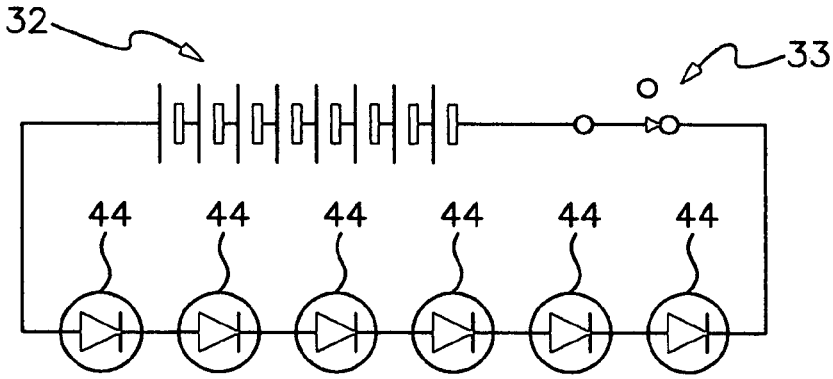
FIG. 7 is an electrical diagram of the headlight assembly showing the battery, the LED's the pump, and an on-off switch.

The LED's 44 are wired in series to the power supply, as shown in FIG. 7, with an on-off switch 33, and this switch 33 also simultaneously turns on the fluid pump 36. The solid-estate semi-coherent light passes through the focusing lens 46 at a 6° focus angle for an effective 200 mm circle of light at 440 mm. The alignment of the LED's 44 and the focusing lenses 46 is best seen in FIG. 4 where it shows that the LED's actually put out an approximately 80° cone of semi-coherent light, which is condensed into a much narrower approximately 6° of conical light with each respective LED focused at the same point, as shown in FIG. 5. These actual distances and relationships can be varied depending upon the particular focus characteristics of the focus lenses 46. It is important to the proper functioning of the LED's that the LED's draw no more than about 50 watts of battery power, and preferably the battery 32 will be between 12 and 24 volts to produce a load of 1 amp to power each of the 12 LED's in the two unit headlamp 24.

Referring again to FIG. 7 of the drawing, the battery 32 is connected through the closing of switch 33 to provide 1 amp in power to the LED array. The LED's 44 are activated and emit bright semi-coherent light through the focus lenses 46 now probably best seen in both FIGS. 3 and 4. This light is then emitted to the focus lenses 46, as best seen in FIG. 4. It is important to note, also, that the semi-coherent light emitted by the LED's is in a lamberton distribution, and this is to achieve the functioning with essentially no ambient heat from the LED's.

The heat generated from the LED's is drawn out through an aluminum heat sink layer 50. With the coolant flowing in the coolant chamber 52 excess heat is carried away from the assembly via the coolant output 54 and coolant input 56 which brings the coolant into the chamber 52. Coolant input 56 and output 54 are connected to a coolant reservoir and pump with flexible tubing, as already described with respect to FIG. 1. The coolant can be water, and it has been found that the flow rate of 400 ml per minute works very well.

Referring now to FIG. 4 in the drawings, the LED's again are indicated by numeral 44 and these sit on top of a printed circuit board 60 that is immediately adjacent to the heats sync layer 50 as described above. The thickness of the heat sync layer 50 is approximately between 2 mm and 2.5 mm and the thickness of the printed circuit board being formed in normal printed circuit fashion is about between 1 and 1.5 mm. Thus, in FIG. 4, the focus lens 28 is indicated generally as comprising the independent lenses 46 associated with each LED, and it further indicates the coolant chamber 52, the inlet tube 56 and the outlet tube 54, as also shown in more detail in FIG. 3 of the drawings. FIG. 6 shows two headlamps 24 mounted adjacent to one another and it is typically thought that the system will operate best with two specific headlight assemblies.

The described surgical headlamp has been demonstrated to produce light intensities at approximately 18 inches in the range of approximately 200,000 lux. This translates to approximately 22,000 flux to 18,560 flux, flux being approximately 10.74-foot candles.

Since other modifications and changes vary to fit particular operating requirements and environments will be apparent to those skilled in the art. Invention is not considered limited to the examples chosen for purposes of disclosure and covers all changes and modifications which do not constitute departures from the true spirit and scope of the invention.

What is claimed is:

1. A headlamp for projecting focus light in a collected pattern at a specific distance from the headlamp which is comprised on a solid state light source consisting of LED's producing a semi-coherent distribution of emitted light, a printed circuit board connecting each LED in series electrical connection, a focus lens arranged in front of the light source for focusing all emitted light in a substantially circular pattern from said LED's, and at a specific desired distance from the said LED's emitted light, means to provide electrical energy to light each respective LED through the printed circuit board and means to cool the respective LED's to maintain a suitable operating temperature being a heat sink layer adjacent the LED's and a fluid circulating adjacent the heat sink layer which is pumped at about 400 ml per minute to provide the cooling of the LED's required for optimum performance.

2. A headlamp according to claim 1, wherein at least two LED's are arranged together to form a light engine, and at least two light engines are arranged in spaced apart side by side relationship to each other so as to form two headlamps operating and focusing at the same point.

3. A headlamp according to claim 2 which includes six LED's for each light engine with them circularly arranged and each LED having a separate focus lens.

4. A headlamp according to claim 3 wherein the means to cool further includes a fluid reservoir, a metallic heat sink layer immediately adjacent each LED and in contact with the electrical contact to the respective LED's, and a pump to pass the liquid adjacent the heat sink layer.

5. A headlamp according to claim 4 wherein the heat sink layer is between 2.0 mm to 2.5 mm thick, and the printed circuit board is between 1 mm to 1.5 mm in thickness.

6. A headlamp according to claim 1 wherein each LED produces a beam of semi-coherent light distribution and each separately focused at 18 inches from the respective LED's, forming a substantially circular shape at a predetermined distance from the LED's.

7. A headlamp according to claim 1 wherein the intensity of the light at the 18-inch range from the lights is approximately 200,000 lux.

8. A headlamp for projecting focus light in a collective pattern at a specific distance from the headlamp which is comprised of a solid state light source consisting of a plurality of LED's producing a semi-coherent distribution of emitted light, a focus lens arranged in front of each light source and focusing all emitted light in a substantially circular pattern from such LED's, and at a specific desired distance form the such LED's emitted light, and means to cool the respective LED's to maintain an suitable operating temperature, wherein the intensity of the light at the 18-inch range from the LED's is approximately 200,000 lux.

9. A headlamp for projecting focused light in a collective pattern at a specific distance from the headlamp which comprises a solid state light source consisting of LED's producing a semi-coherent distribution of emitted light, a printed circuit board connecting each LED in series electrical connection, a focus lens arranged in front of the light source for focusing all emitted light in a substantially circular pattern from said LED's, and at a specific desired distance from the said LED's emitted light, means to provide electrical energy to light each respective LED through the printed circuit board, and a heat sink system comprising a fluid reservoir, a metallic heat sink layer immediately adjacent the reservoir and each LED, and a pump to pass the liquid from the reservoir adjacent the heat sink layer sink layer, wherein the fluid is passed from the reservoir at a predetermined flow rate to cool the respective LED's to maintain a predetermined operating temperature, and the heat sink layer is between 2.0 to 2.5 mm thick.

10. A headlamp according to claim 9 wherein the predetermined flow rate is at about 400 ml per minute to provide cooling of the LED's.

11. A headlamp according to claim 9 wherein the intensity of the light at the 18-inch range from the LED's is approximately 200,000 lux.

12. A headlamp according to claim 9 wherein each of the plurality of LED's has an individual focus lens arranged in front of it so as to focus emitted light from that particular LED in a predetermined pattern and distance from the particular LED.

* * * * *